United States Patent [19]

Lancaster et al.

[11] 4,050,220

[45] Sept. 27, 1977

[54] SPIRAL BUNDLER

[76] Inventors: William G. Lancaster, 5101 Upper River Road; Patrick R. Lancaster, III, 9410 Tiverton Way, both of Louisville, Ky. 40222

[21] Appl. No.: 568,269

[22] Filed: Apr. 15, 1975

[51] Int. Cl.[2] ..... B65B 13/12

[52] U.S. Cl. ..... 53/198 R; 53/184 R; 53/203; 93/80

[58] Field of Search ..... 53/30 R, 180 M, 182 M, 53/184 R, 198 R, 203; 93/80; 242/7.22, 7.23; 225/97

[56] References Cited

U.S. PATENT DOCUMENTS

| | | | |
|---|---|---|---|
| 603,585 | 5/1898 | Crowell | 53/198 R X |
| 1,417,591 | 5/1922 | Anderson | 53/182 X |
| 2,423,294 | 7/1947 | Colesworthy | 53/30 X |
| 2,575,467 | 11/1951 | Reichel et al. | 53/180 X |
| 2,863,270 | 12/1958 | Elmer Jr. | 53/198 R |
| 3,000,167 | 9/1961 | Pierce, Jr. | 242/7.23 X |
| 3,003,297 | 10/1961 | Broadhead et al. | 53/198 R |
| 3,097,462 | 7/1963 | Langdon | 53/198 R X |
| 3,158,973 | 12/1964 | Monaghan | 53/182 X |
| 3,309,839 | 3/1967 | Lyon | 53/198 R |
| 3,331,312 | 7/1967 | Leslie et al. | 53/198 R X |
| 3,473,288 | 10/1969 | Nakamura et al. | 53/182 X |
| 3,559,367 | 2/1971 | Misik | 53/182 R X |
| 3,727,365 | 4/1973 | Stohlquist | 53/182 X |
| 3,737,084 | 6/1973 | Noel | 225/97 |
| 3,788,199 | 1/1974 | Sato et al. | 93/80 |
| 3,867,806 | 2/1975 | Lancaster et al. | 53/30 X |
| 3,910,005 | 10/1975 | Thimon et al. | 53/198 R |

FOREIGN PATENT DOCUMENTS

| | | | |
|---|---|---|---|
| 2,256,708 | 5/1974 | Germany | 53/198 R |

*Primary Examiner*—Othell M. Simpson
*Assistant Examiner*—John Sipos
*Attorney, Agent, or Firm*—Gipple & Hale

[57] ABSTRACT

The invention comprises a novel apparatus and process for making unitary packages from a continuous wrapping process. In the apparatus a series of loads, each containing a plurality of cartons are fed into a wrapper apparatus and covered by a spiral stretched film to form a unitary continuous packaged bundle. The bundle proceeds on to a cutting area where the loads are severed into individual packages which are carried off to a stacking or processing station. The apparatus utilizes wrapping guide rails which receive the loads so that the wrapping ring mechanism continuously wraps each load and its supporting guide rails with the wrapping being pulled off the guide rails to contact against each load forming a spiral wrapped bundle encapsulating the loads. The spiral bundle is carried to a cutting station which severs each individual load from the spiral bundle.

11 Claims, 15 Drawing Figures

SPIRAL BUNDLER

BACKGROUND OF THE INVENTION

The present invention generally relates to packaging and more particularly to a method and apparatus for making unitary packages holding a plurality of components with each package containing a load that has a covering of a sheet of material wrapped around it.

Case packing or boxing is a common way of shipping multiple unit products. The multiple unit products are generally stacked in a corrugated box or are wrapped with kraft paper with the ends of the kraft paper being glued or taped. Another way of shipping such products is by putting a sleeve or covering of heat shrinkable film around the products and shrinking it to form a unitized package. The use of heat shrinkable film is described in U.S. Pat. Nos. 3,793,798, 3,626,654, 3,590,509 and 3,514,920. A discussion of this art is set forth in U.S. Pat. No. 3,867,806.

The present invention provides a simple more reliable and cheaper method of unitizing small products into packages.

When the present process and apparatus is compared with other apparatus and processes currently used to pack products in corrugated boxes and the cost of the corrugated boxes themselves, the invention shows an enormous cost savings. The invention has compariable costs with kraft wrap but it gives a much tighter and better unitized package than that possible with kraft wrap. In addition to these factors, the invention has a product visibility which is not present in boxes and kraft wrap. When the invention is compared with most existing shrink film systems the proposed system offers packaging speed, reliability of package seal and energy savings in that less energy is required to package the products.

A basic problem with shrink packaging is that the primary strength and reliability of the package is determined by the consistent quality of the seals. These seals depend on a careful maintenance of the sealing jaw and are never as strong as the film itself. The time that it takes to make the seals is a limiting factor on the possible speeds of most shrink systems.

The present invention does not require any structural seal but maintains the individual cartons or materials which are packaged in a tightly positioned area. In the present invention the system allows for continuous motion in the wrapping process with no critical seals being necessary in the process.

The use of wrapping machinery in the art is known and one such apparatus is shown by U.S. Pat. No. 3,003,297 in which tape is placed by a rotating ring on a box carried by a conveyor line. A complex cutting and holding mechanism is used to place the tape on each box and cut it off with the process being repeated for each box. Another application in packaging is shown by U.S. Pat. No. 3,514,920 in which heat shrink film is wrapped around a pallet supporting a plurality of cartons. Furthermore, it is also known in the art to spirally wrap articles. Such spiral wrapping is shown by U.S. Pat. Nos. 3,788,199, 3,549,077, 3,191,289 and 2,716,315.

The present invention uses stretchable plastic film in its preferred embodiment since the mechanical stretching of the film utilizes its strength better than a heat shrink wrap. The elasticity in the film holds the products in more tension then either the shrink wrap or the kraft wrap particularly with products which settle or relax when packaged.

Various apparatus and processes have been developed by the present inventors to utilize stretch material in package wrapping. Such apparatus and processes are disclosed in U.S. Pat. No. 3,867,806 and U.S. patent application Ser. Nos. 454,477 and 478,523, which have been filed by the present named inventors of this invention. These applications are incorporated herein in their entirety in this application by reference.

Additional benefits occur in the present invention over the prior art in that no changeover is required in handling random size units of a variety of materials as the apparatus is constructed to handle such random size units. Furthermore, the apparatus provides a continuous wrapping operation so that loads can be wrapped at any desired speed. A significant economic factor is also present in the present invention since the power requirements are significantly less than those of shrink systems since there is no heat tunnel required and greater speeds of operation are possible because of the elimination of the conventional heat seal which is used in shrink type wrapping. Because of the simplicity of the construction there is a greater stability of the wrapping apparatus with less maintenance being required to maintain the apparatus and a corresponding reduction in breakdown time.

SUMMARY OF THE INVENTION

The present invention generally comprises a novel apparatus and process for making unitary packages in a continuous wrapping process. In the apparatus a series of loads each containing a plurality of boxes are fed into a wrapper apparatus and covered by a spiral stretched film to form a unitary continuously packaged bundle. The bundle is then transported to a cutting area where the loads are severed from the bundle into unitary packages which are then carried off to a stacking or processing station. Thus the apparatus provides a novel conveyor wrap means and wrapping apparatus used in connection with the wrap means to continuously wrap the loads so that they may be carried on to a cutting station which severs each load from the spiral bundle.

Although the invention will be set forth in the claims the invention itself and the manner in which it may be made and used, may be better understood by referring to the following description taken in connection with the accompanying drawings forming a part hereof in which like reference numerals refer to like parts throughout the several views and in which:

DETAILED DESCRIPTION OF THE DRAWING

Figure 1:
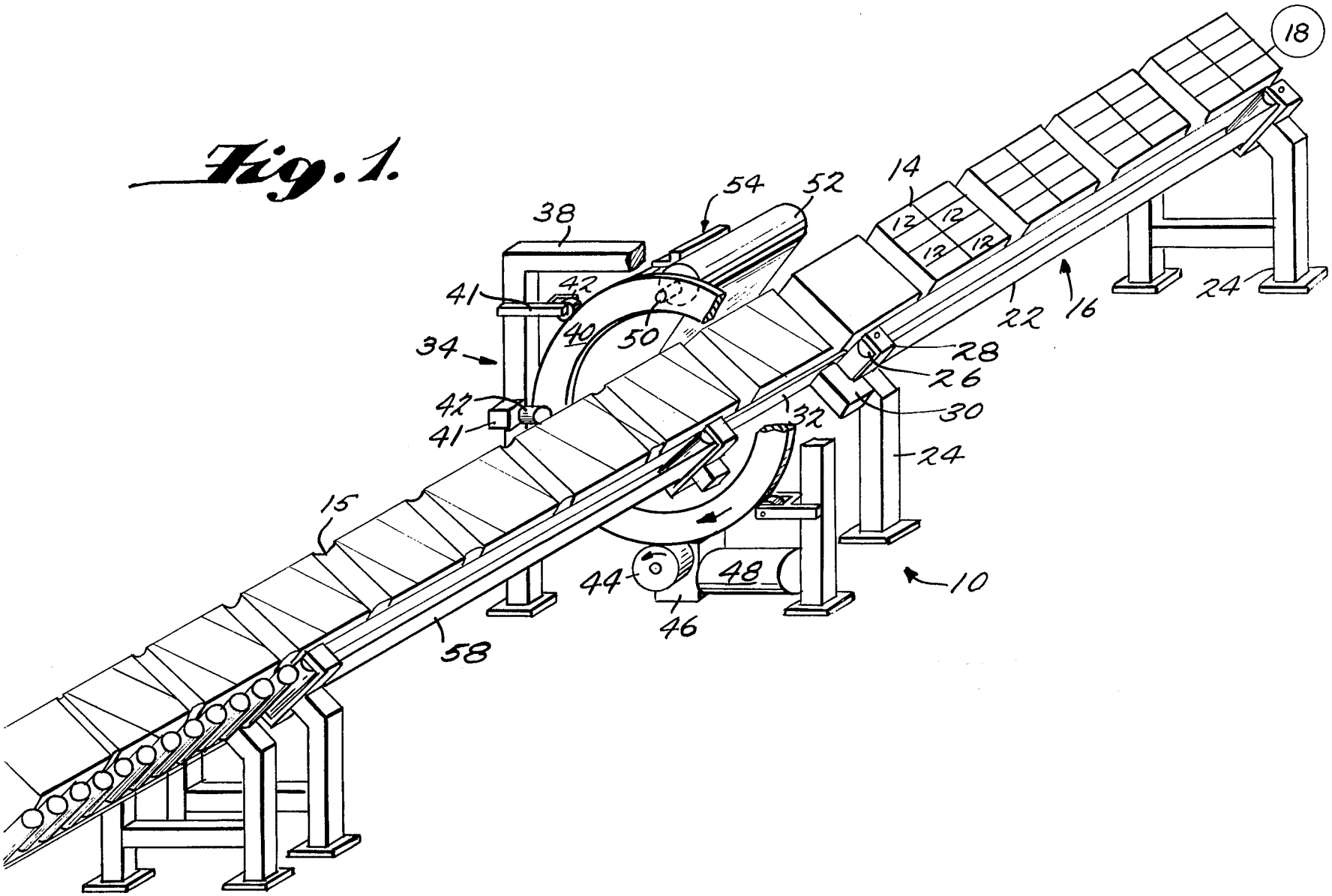
FIG. 1 discloses a perspective view of the invention partially in section disclosing the apparatus and noval packing process.
Figure 2:
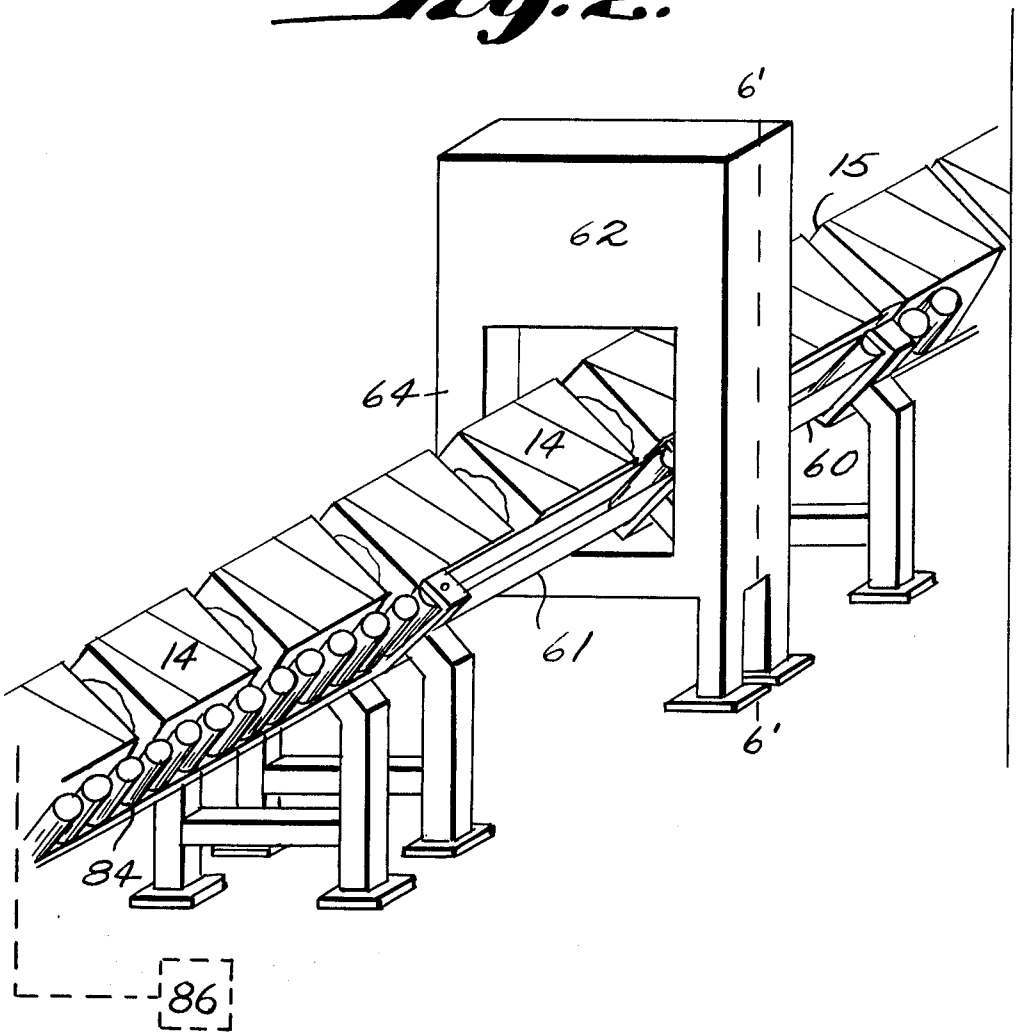
FIG. 2 discloses a side perspective view of the cutting section of the invention shown in FIG. 1.
Figure 3:
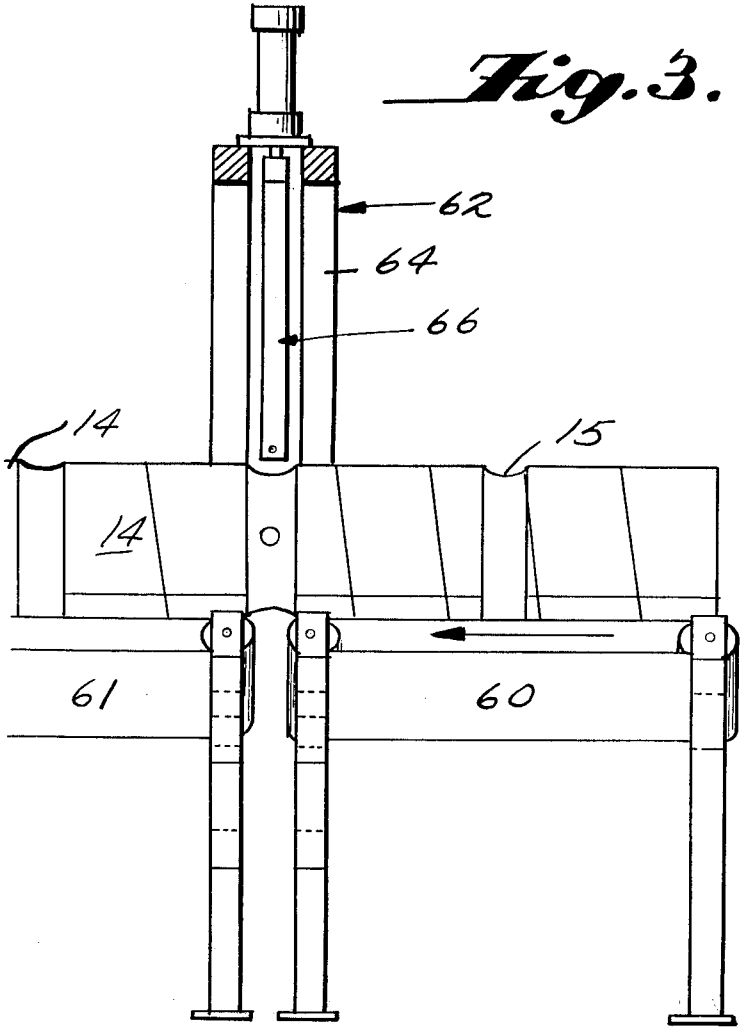
FIG. 3 discloses a cross section of the cutting apparatus of FIG. 2.

The invention as disclosed in drawings 1–15 shows a spiral bundling apparatus 10 which is constructed of various sections basically comprising an infeed device, a product wrap guide wrapping mechanism, take away device and cutting mechanism which separates the unitized packages after they have been wrapped. As shown in FIG. 1 a plurality of cartons 12 forming a load 14 have been loaded in a spaced relationship onto an infeed conveyor 16 by either manual or mechanical means represented by a loading device 18. It should be noted that the loads, depending on their nature and composition may or may not require spacing. The loading device is schematically shown and may be one of a number of types of stacking or placing devices which are well known in the art to place a stack of cartons or materials on a designated area.

In the preferred embodiment the load 14 is placed on an infeed conveyor mechanism 16 which is comprised of two parallel driven endless belts 22 mounted on frame supports 24.

Figure 15:
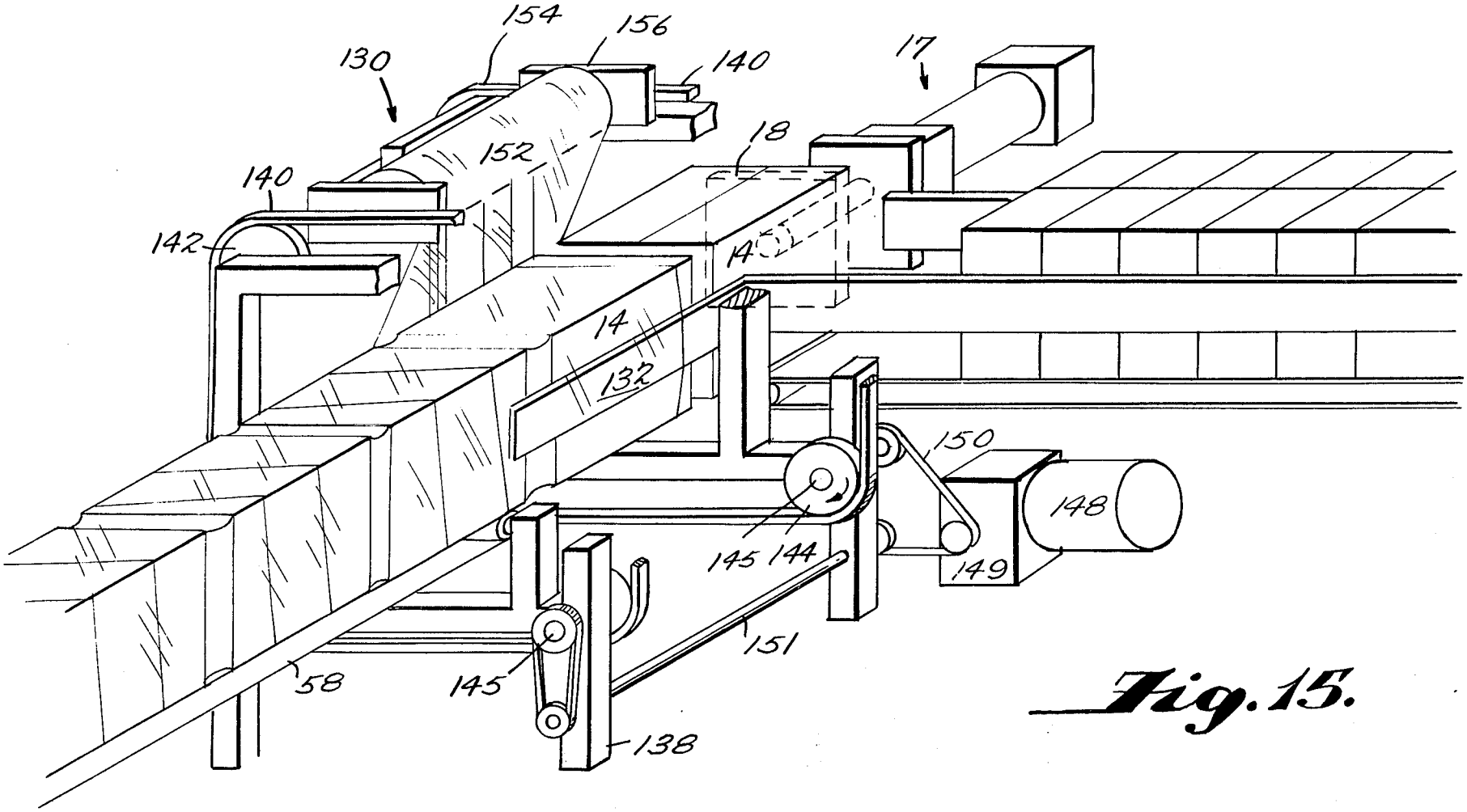
FIG. 15 discloses a perspective view, partially in section of another embodiment of the wrapping apparatus, guide assembly and conveyor system.

An alternate embodiment of the infeed conveyor mechanism is shown in FIG. 15 in which a hydraulic or pneumatic pushing device 17 engages each load 14 with its platen 18 to push the load into the wrapping area. The belts of the preferred embodiment are preferably textured so that they have a high coefficient of friction. The belt conveyors are preferably perpendicular to each other to form a seat for the load. By having the belt conveyors positioned in this particular configuration the size of the product is not restricted. The particular arrangement set forth nicely lends itself to random variations of total unit size in all three dimensions. It is apparent however that other configurations could be constructed which would be advantageous to specific products. Thus the conveyance of 12 packs or 6 packs of cans or bottles for example could be handled by a horizontal conveyor with guide rails on each side.

The conveyor belts are mounted on rollers 26 which are rotatably journaled by suitable bearing means in brackets 28 which are secured to the frame support 24. Wrapping rail braces 30 are secured to the downstream side of the conveyor 16 to hold wrapping rails 32 which are secured to them. The infeed conveyor 16 carries the loads 14 onto a wrapping station 34 comprising a wrapping apparatus and wrapping rails or horns 32.

The preferred embodiment of the wrapping apparatus comprises a frame 38 on which an aluminum "doughnut" or ring shaped film support member 40 is rotatably mounted and supported in three planes by guide wheels 42. The plurality of rotatable guide wheels 42 extend outward from the frame 38 on arms 41 to contact the "doughnut" shaped member 40 so that it can be driven along a particular path. A friction drive wheel 44 is positioned adjacent the "doughnut" member 40 at its base and engages the member 40 to rotate the member 40 within the guide wheel roller area. The friction drive wheel 44 is driven by a motor 48 having a shaft which is suitably connected with a drive reducer 46.

A material roll dispensing shaft 50 is rotatably secured to the "doughnut" member 40 to freely rotate on its axis and is adapted to receive and hold a roll of film material 52.

While various stretchable materials can be used for the rolled film of overwrapping material, excellent results have been obtained by using a polyethelyne film having density in a range from 0.915 through 0.922 which can be stretched in an elongation range from 2 through 100% under 600 to 2,000 P.S.I. of force.

A film roll friction brake mechanism 54 is mounted on support members 56 secured to the "doughnut" shaped member 40 and engages the outer surface of the film roll 52 to maintain constant tension on the film material leaving the roll to cover the load providing a desired degree of stretch to the film. Normally the leading edge of stretchable material is withdrawn from the roll without tension and placed against the first load before tension is applied, however, if desired the leading edge can be placed under initial tension.

The brake mechanism 54 comprises support members 56 rotatably holding two brake arms 60 and an adjustable spring member 58 secured to each of the brake arms 60. At the end of each brake arm 60 a curved brake shoe assembly is mounted for engagement with the roll. The brake shoes 62 are thus constantly urged against the exterior of the film roll to provide a constant tension on the roll and stretch the film as it is being wrapped around the loads.

Figure 4:
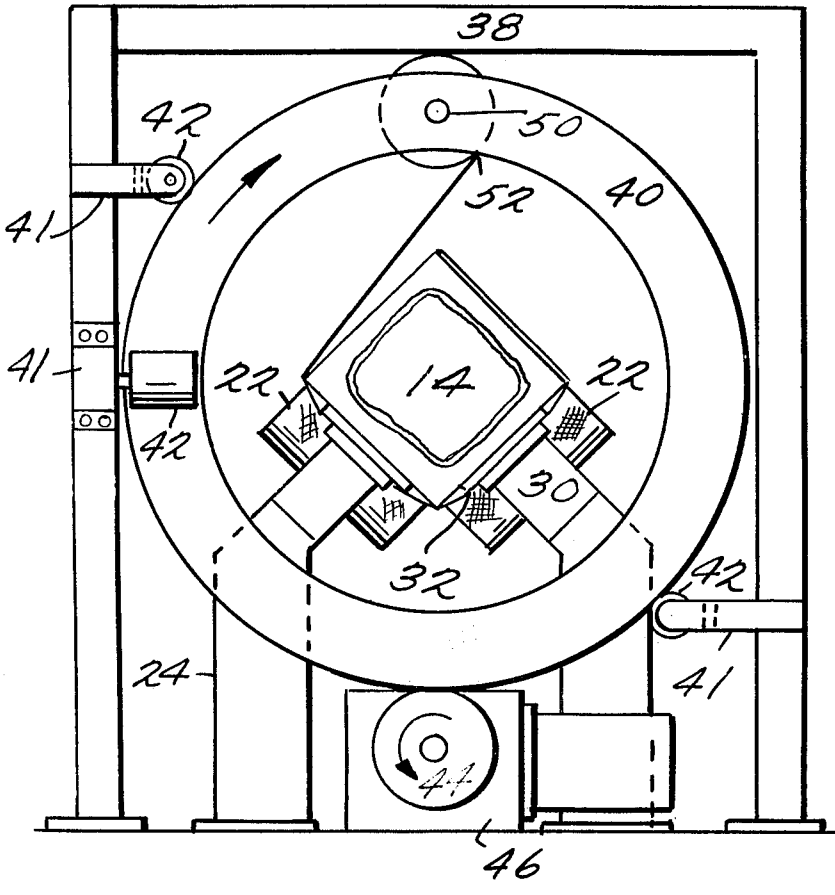
FIG. 4 discloses an enlarged cross sectional view of the wrapping apparatus and guide assembly.
Figure 7:
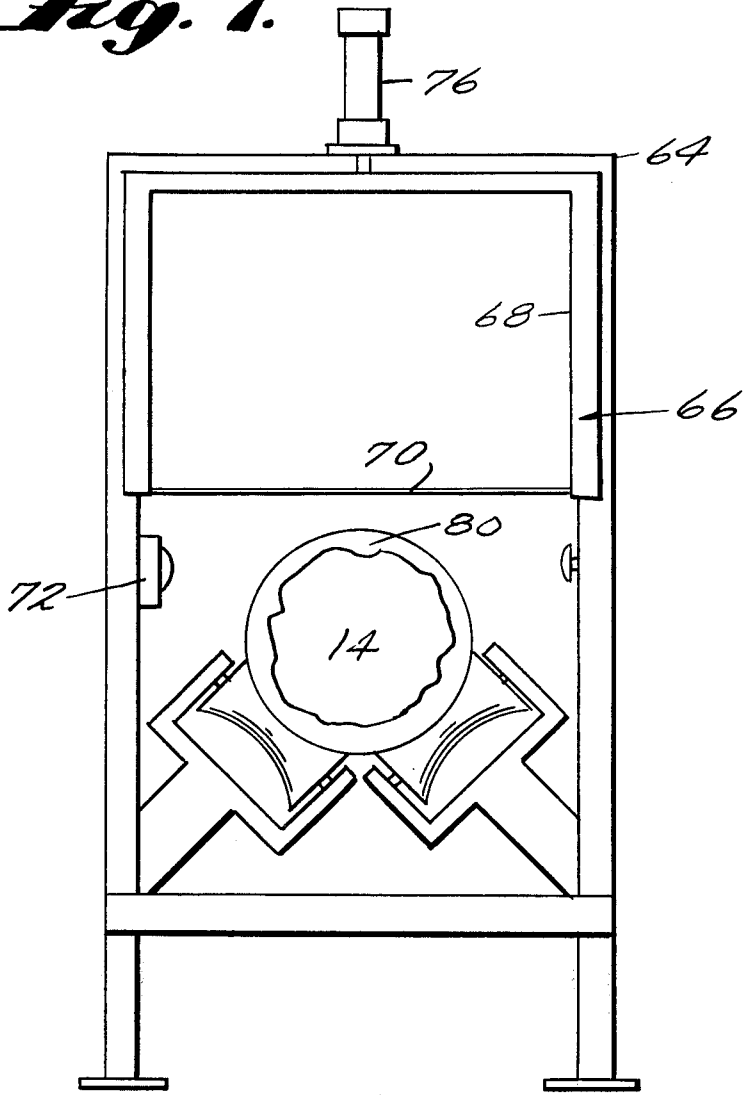
FIG. 7 discloses an enlarged side view of another configuration of the cutting mechanism.
Figure 6:
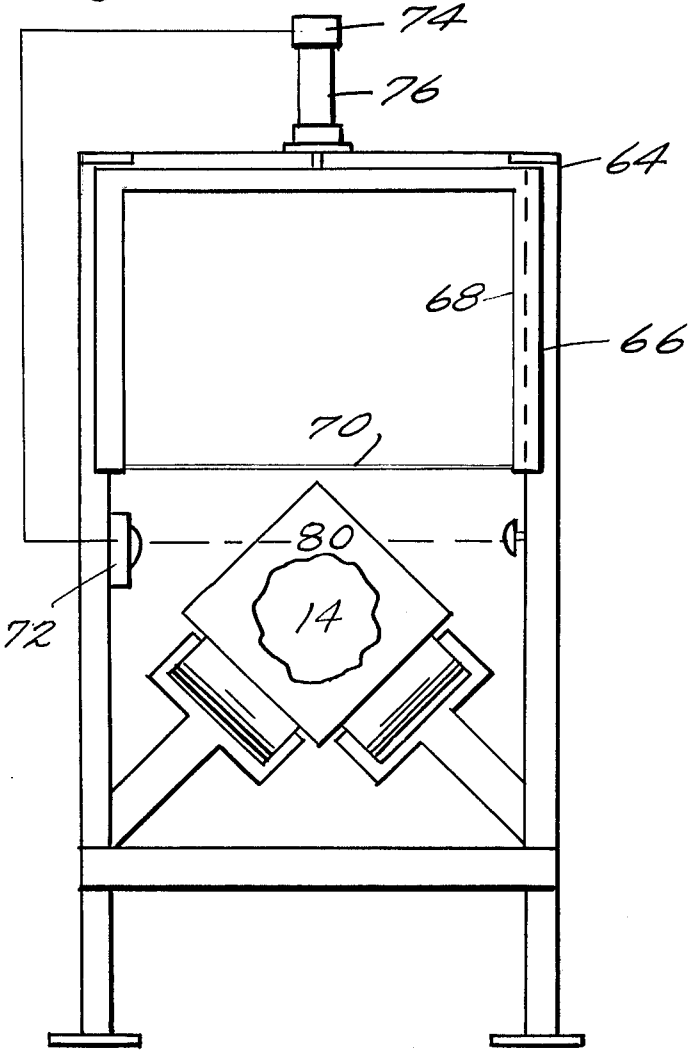
FIG. 6 discloses an enlarged side view of the cutting mechanism taken along line 6'—6' of FIG. 2.
Figure 8:
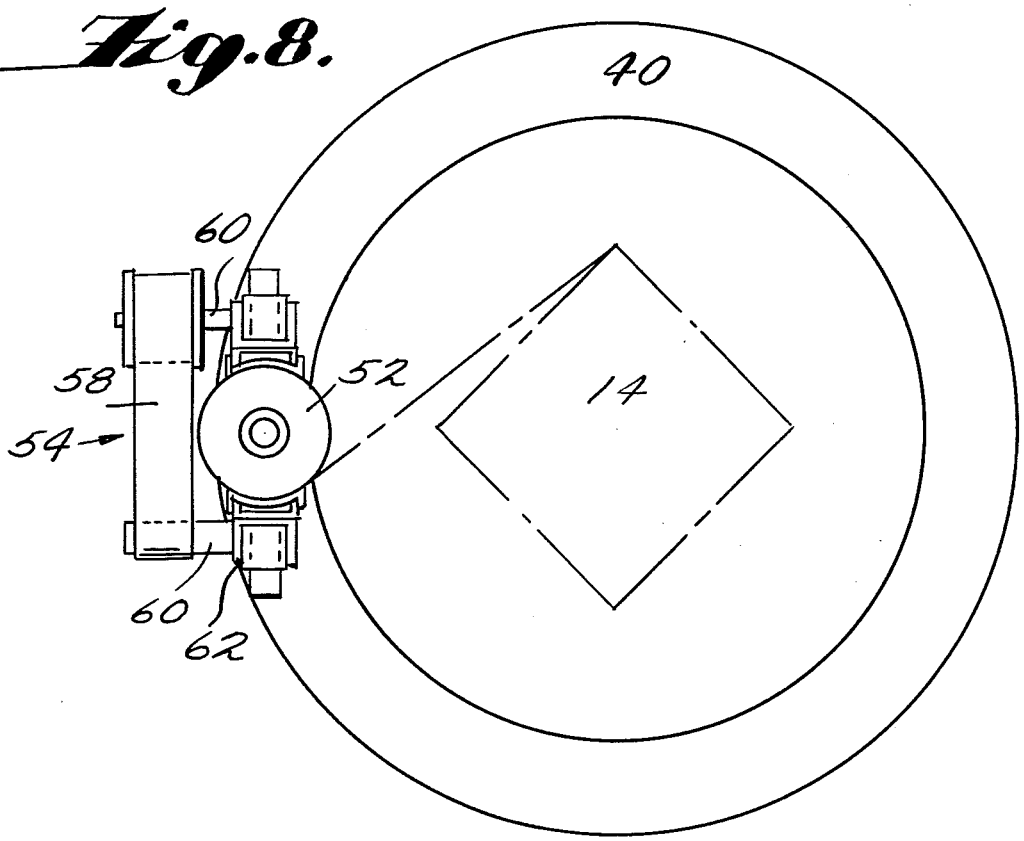
FIG. 8 discloses a front perspective view of the brake mechanism used with the invention.
Figure 9:
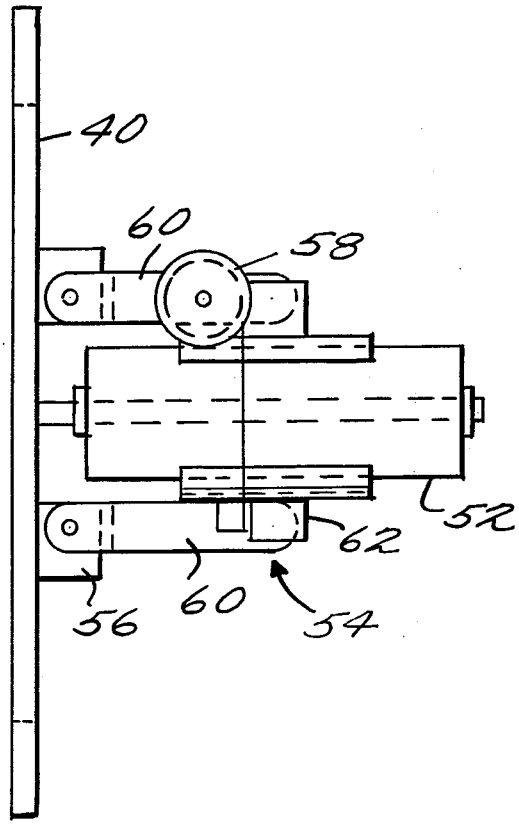
FIg. 9 shows a side perspective view of the brake mechanism of FIG. 8.

The wrapping guide rails or horns 32 support the load while it is being wrapped. These wrapping guide rails 32 are designed so that they can be wrapped up with the film and yet allow the wrapped film to continuously slide off of them as the spiral bundle is pulled away. In the preferred embodiment, as shown in FIG. 4 the guide rails comprise two plates which are cantilevered from their upstream end and are positioned plannar with each infeed conveyor belt.

Figure 5:
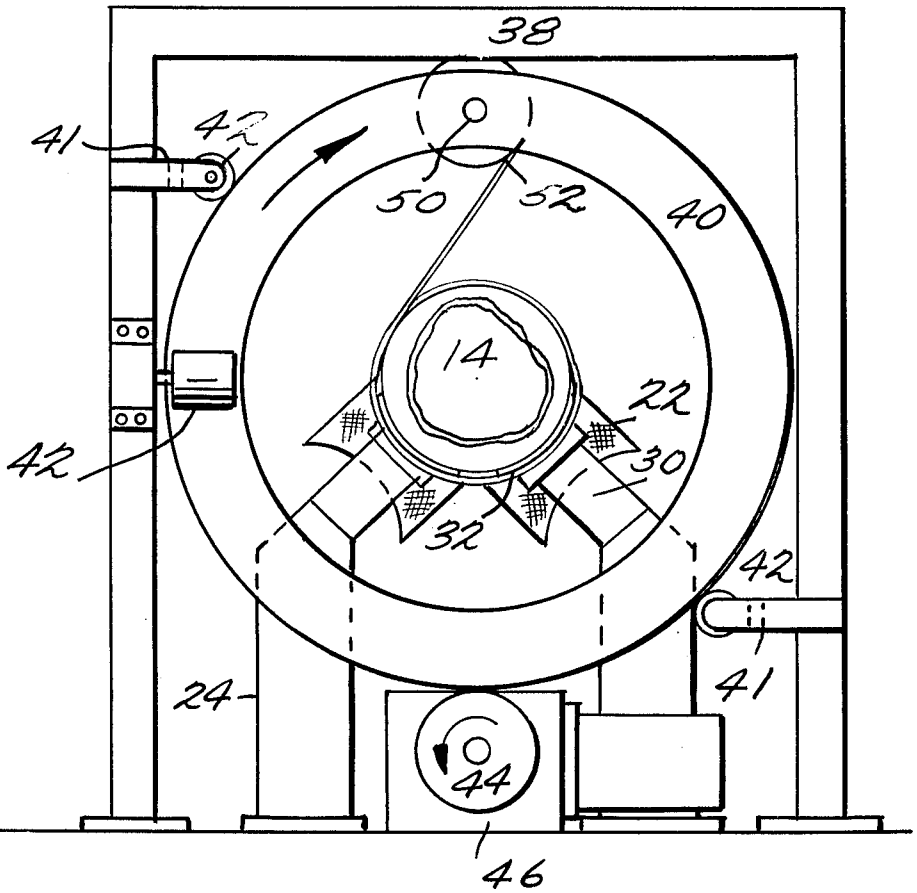
FIG. 5 discloses an enlarged cross sectional view of another configuration of the wrapping apparatus and guide assembly.

The wrapping horns or guide rails 32 can alternatively be of the semi circular construction as shown in FIG. 5 or of any other suitable construction which may be necessary to hold the product which is being wrapped. It is also envisioned that the guide rails can be constructed out of a porous or hollow material so that air can be communicated to the rails under pressure so that air passes through pores or holes in the rail material forming an air blanket for the film and load as it passes through the wrapping area.

Another embodiment of the wrapping apparatus is shown in FIG. 15. This wrapping apparatus 130 comprises a frame 138 on which two endless track guides are mounted to this frame. A drive chain 140 is mounted in the guides in engagement with guide sprockets 142 and drive sprockets 144. The plurality of rotatable guide sprockets 142 extend outward from the frame 138 on shafts 141 to engage and drive each drive chain along a particular path. A drive sprocket 144 for each drive chain is rotatably mounted on a shaft 145 which is rotatably mounted through one of the standards of the frame. The drive sprocket 144 engages the drive chain to rotate the drive chain over the guide sprockets 142. The drive sprockets 144 are driven by a motor 148, reducer 149 and associated drive belt or chain 150. The drive belt 150 engages the motor shaft, a drive member of one drive sprocket shaft and a second drive shaft 151 which transfers the drive to the second drive sprocket.

A film roll friction brake mechanism 154 is mounted on support members 156 secured to the two chains 140 and engages the outer surface of the film roll 152 to maintain constant tension on the film material leaving the roll to cover the load providing a desired degree of stretch to the film. A material roll dispensing shaft not shown is rotatably secured to each support member 156 to freely rotate on its axis and is adapted to receive and hold the roll of film material 152. Normally the leading edge of stretchable material is withdrawn from the roll without tension and placed against the first load before tension is applied, however, if desired the leading edge can be placed under initial tension. After the edge of the stretchable material has been withdrawn the motor is energized driving the track members and roll around the loads and spirally wrapping them with material.

The brake mechanism 154 comprises a curved brake shoe assembly mounted for engagement with the roll through a spring member. The brake shoe is thus constantly urged against the exterior of the film roll to provide a constant tension on the roll and stretch the film as it is being wrapped around the loads.

Wrapping guide rails or horns 132 support the load while it is being wrapped and function like the guide rails previously described.

The rails 32 and 132 lead to a take off conveyor 58 constructed like the infeed conveyor 16 and which runs at the same speed as the infeed conveyor. In order to control both conveyors at the same rate of speed a suitable mechanical means not shown is set up to connect the drive of both the infeed and take off conveyors with the reduction gearing assembly of the drive motor 48 and 148. Thus if the motor slows down or speeds up to drive the wrapping mechanisms at different speeds, the infeed and takeoff conveyors are simultaneously speeded or slowed down so that the spiral bundle moves at a consistantly relative speed. It should be noted that as the film leaves the film roll it is placed under tension, canted and continuously spirally wrapped to form a wrap on each following load of cartons. The takeoff conveyor 58 draws the spiral wrapped loads connected together by the film overwrap continuously through the wrapping station and off the wrapping guide rails 32. The infeed and takeoff conveyors carry the spiral wrapped bundle onto cutting conveyors 60 and 61 which run intermittently at a faster speed and a dead stop so that the spiral bundle is not moving when it is cut apart to unitize each load but is able to effectively carry the loads away from the wrapping area.

The cutter conveyors 60 and 61 take the wrapped spiral bundle into a guillotine like cutting apparatus 62 comprising a frame 64 and a cutter mechanism 66 slidably mounted to the frame. The cutter mechanism 66 consists of a bow frame 68 strung with a hot nichrome wire 70 which is electrically connected to a source of energy. The resistance of the wire causes sufficient heating so that when the wire is reciprocated between the encapsulated loads 14 to cut them apart the film material is simultaneously bonded at the edges so that the film will not unravel in shipment. As a wrapped load 14 of the spiral bundle 15 enters the cutting area, a sensor 72 projects a light source through the transparent film and the space between the loads 14 against the photoelectric reflector 73 to generate an electrical signal signaling the cutter blade drive mechanism 74 to activate a pneumatic or hydraulic cylinder 76 driving the hot cutter wire 70 through the film severing the load 14 from the spiral bundle 15. The wire is heated by connecting it to a current source of about 9 volts which heats the wire sufficiently so that the edges of the film are bonded to form a holding edge 80. The severed edge which has been stretched reverts back to its original memory shape to form the holding edge. As the spiral bundle 15 advances, the next spacing between the loads 14 is sensed by the light sensor 72. The conveyor is then stopped and the cutting wire 70 which has been driven downward is lifted upward severing the wrapped load from the spiral bundle as previously mentioned.

Figure 12:
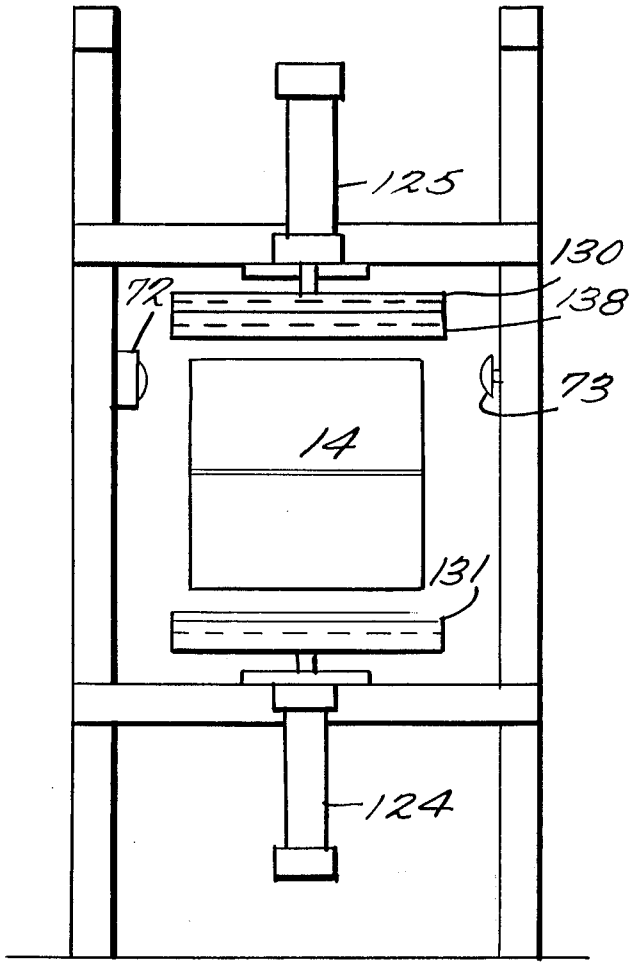
FIG. 12 discloses the cutting mechanism embodiment of FIGS. 3, 6 and 7 with a sealing bar attachment.
Figure 14:
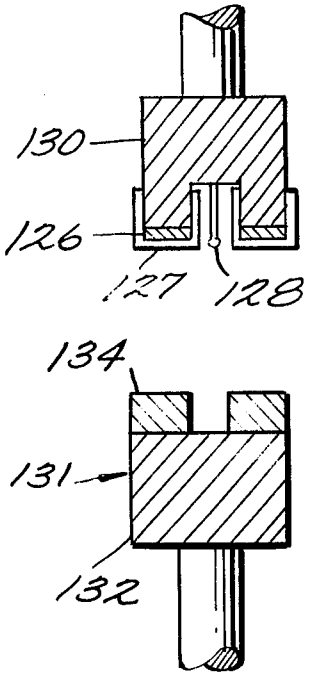
FIG. 14 discloses an enlarged cross-sectional side view of the sealing bars of the cutting mechanism shown in FIG. 13.
Figure 13:
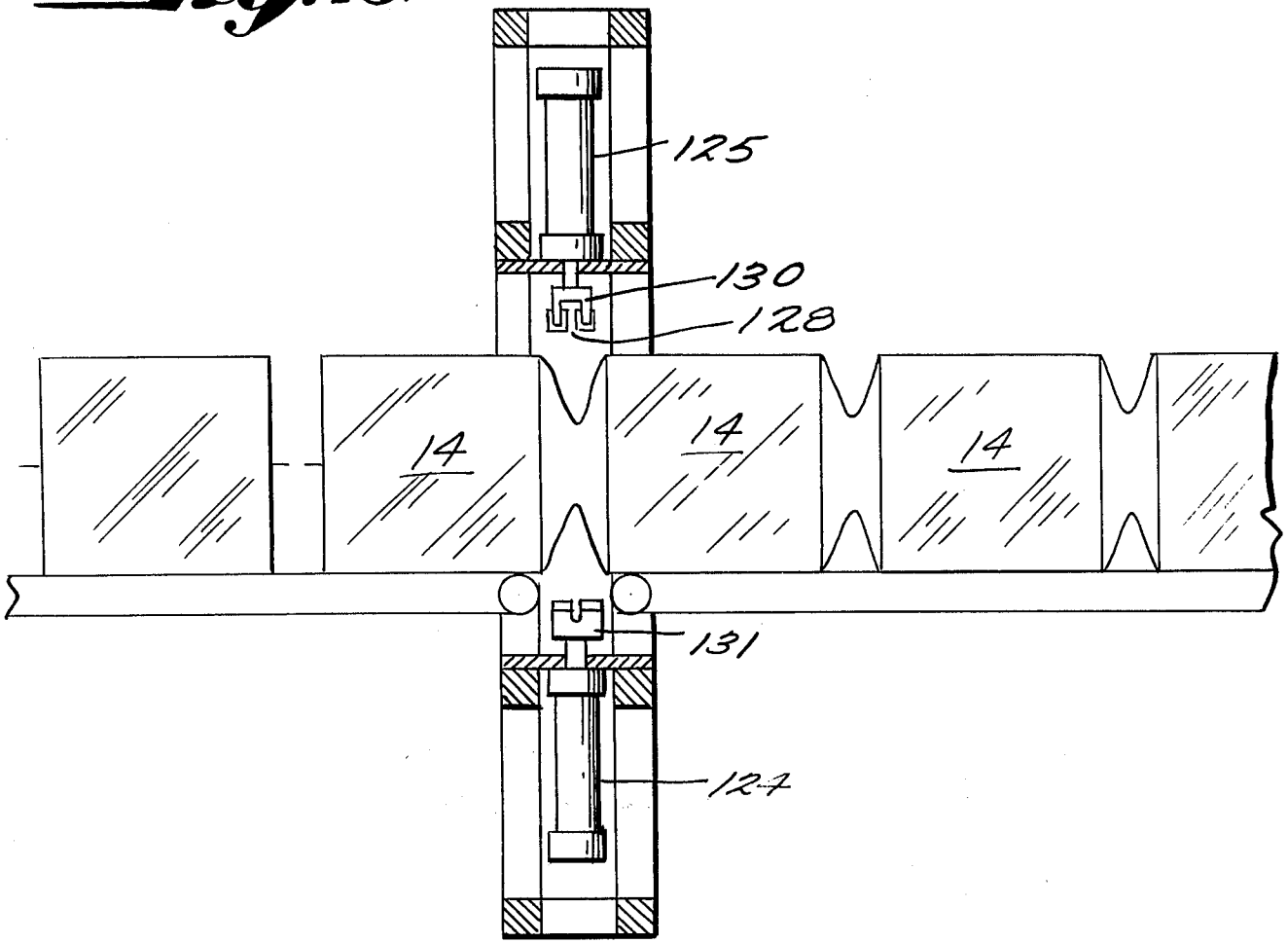
FIG. 13 discloses a cross-sectional side view of the cutting mechanism shown in FIG. 12.

Another embodiment of this cutter mechanism as shown in FIGS. 12 and 13 uses a heat seal. In this embodiment an upper seal bar 130 is mounted on a pneumatic cylinder 125 and a lower resilient bar 131 is mounted on another pneumatic cylinder 124. These cylinders are activated in the manner previously described and the wrap material is then bonded by the heat sealing bar 130 when the material is severed. The bars as shown in FIG. 14 comprise an upper horseshoe shaped sealing bar 130 having nichrome heat seal elements 126 secured to the ends of its arms. Each heat seal element is covered by a teflon cover 127 secured to the sealing bar 130. A nichrome cut-off wire 128 is positioned between the arms of the sealing bar and secured to the ends of bar 130. A lower horseshoe shaped sealing bar 131 is formed by a base 132 and resilient pads 134 secured to the base. When the cutter mechanism is activated, the wire 128 cuts through the wrapping material of the spiral bundle and the heated teflon cover 127 bonds the material on its downward path until it strikes the resilient pad and is pulled upward.

Figure 11:
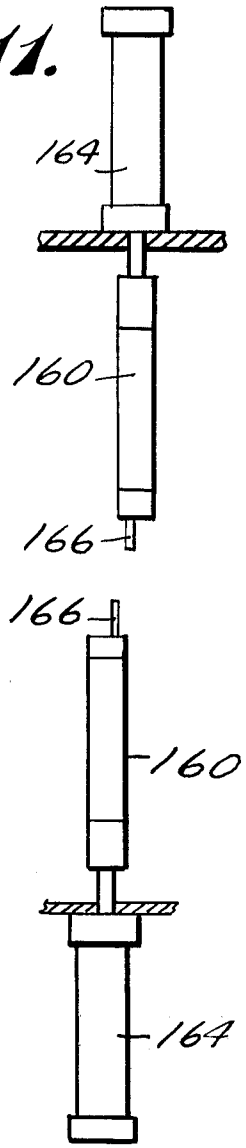
FIG. 11 shows a cross sectional side view of the cutting assembly of FIG. 10.
Figure 10:
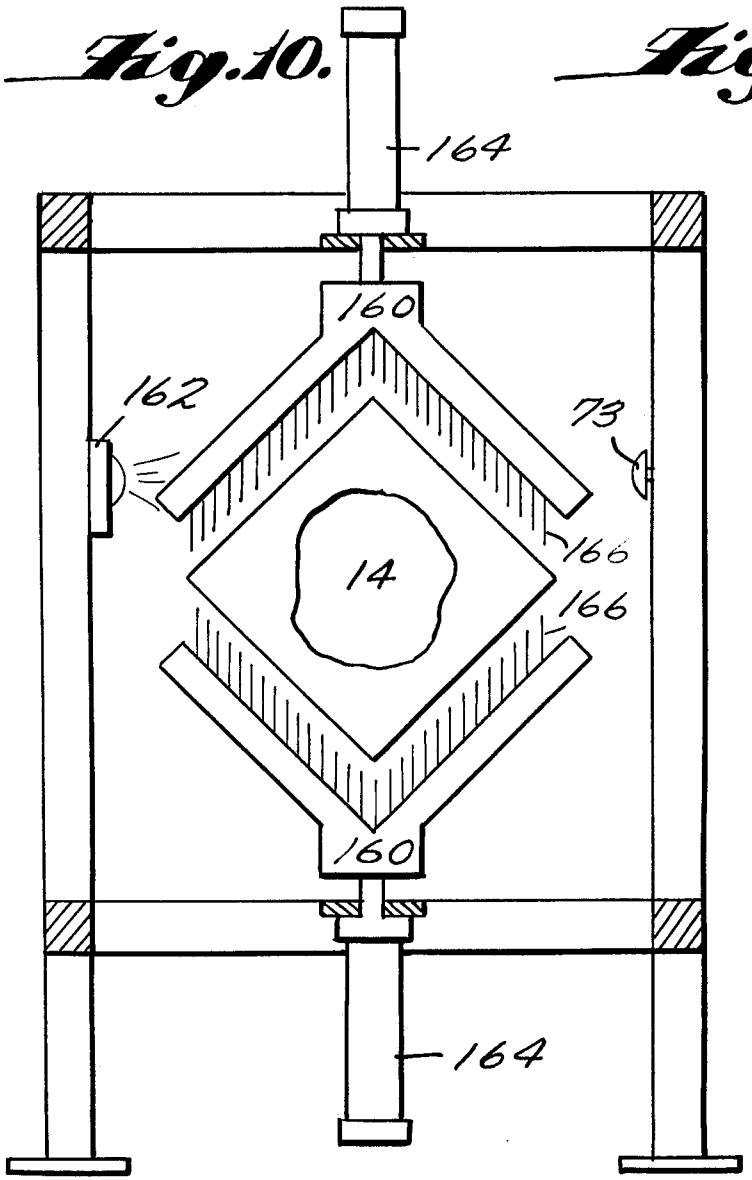
FIG. 10 discloses an enlarged front view partially in section of another embodiment of the cutting assembly.

Another type of cutting apparatus is envisioned as being used in the invention. In FIGS. 10 and 11 apparatus is disclosed which allows the film to be cut while the spiral bundle is moving. In this embodiment hydraulic or pneumatic operated frames 160 are electrically connected to sensor 162 which operates as the previously described sensor to sense the spacing between loads. Such sensing apparatus are well known in the art and any standard circuit can be used to cause the pneumatic cylinders 164 to be activated when the sensors send an appropriate electrical signal. Likewise a limit switch, contact switch or other suitable electrical means can be used to activate the cylinder 164 to carry the frame 160 upward. Secured to each frame 160, which is of suitable configuration to correspond with the load being cut, are a plurality of pins 166 which are placed on each frame so that a straight line is formed if a line is drawn from one end pin to the other end pin. When the frames are driven toward each other, the pins 166 strike the wrapping material substantially simultaneously causing the material to shear in a straight line around the bundle so that the load is severed with a substantially circular cut. It has been found that since the material is under tension the film cuts from pin to pin rather than simply having the pins puncture a series of holes in the film.

It should be noted that a plurality of the previously described cutting devices can be used to sever several loads simultaneously from the spiral bundle.

A dead roller exit conveyor 84 handles the wrapped load by carrying the finished package loads away to be disposed of in a suitable manner or to be wrapped into other larger units as has been previously described by the other inventions of applicants.

If a PVC type film is used, then the film cutting is done with knives instead of the hot wire. Since most PVC has excellent tack characteristics it does not need its edges to be heat bonded to prevent unraveling.

The invention can also be used with heat shrink material rather than stretch material, with the utilized package being run off by a separate conveyor means into a heat shrink tunnel 86 to provide the desired heat shrink required for shrinking the unitized load.

In the foregoing description the invention has been described with reference to a particular preferred embodiment although it is to be understood that the specific details shown are merely illustrative and that the invention may be carried out in other ways without the departing from the true spirit and scope of the following claims.

What is claimed is:

1. Apparatus for wrapping a plurality of loads and unitizing the loads into wrapped packages; comprising conveyor means adapted to receive a plurality of loads; each said load comprising a plurality of members, wrapping means positioned adjacent said conveyor means, said wrapping means comprising a frame, a circular roll dispenser means rotatably mounted on said frame, and guide wrapping rails axially aligned with said conveyor means adapted to receive said load from said conveyor means and substantially support said loads, said roll dispenser means being adapted to hold a roll of material and wrap said material around a load and guide wrapping rails supporting said load, said roll of material defining a path during the wrap cycle which path provides that the roll of material is always a constant distance from the center of the roll dispenser means, drive means connected to said roll dispenser means to drive said roll dispenser means so that it continuously deposits material around said guide rails and loads to form a spiral wrapped load, and brake means mounted to said roll dispenser means, said brake means being adapted to engage the outer surface of a roll of material mounted on said roll dispenser to place a constant and uniform tension on said rail substantially stretching material being dispensed from said roll onto said load; a second conveyor means positioned adjacent to said guide rail means adapted to carry said continuously wrapped bundle of a plurality of loads away from said wrapping means and cutting means positioned adjacent said second conveyor means, said cutting means comprising a frame, a cutting device reciprocally mounted in said frame and means to vertically reciprocate said cutting device in said frame to cut through said material overwrapping said loads to separate each load into a wrapped unitary package, said cutting means being operable in two directions such that a first separation is performed by the downward movement of said cutter means between the spacing formed between the loads and a second separation is performed by the subsequent upward movement of said cutting means between the immediately following spacing formed between the loads, and sensor means positioned next to said frame comprising light transmission means adapted to transmit light through said material overwrap to sense the spacing between loads, said spacing when sensed by said sensor means causing activation of said cutting means.

2. Apparatus as claimed in claim 1 wherein said cutting means comprises a heat conducting wire, a frame holding said wire and electrical means connected to said wire.

3. Apparatus as claimed in claim 1 wherein said second conveyor means stops during the cutting operation of said cutting means.

4. Apparatus as claimed in claim 1 including sealing means adapted to seal said wrapping material together at the front and rear of each package to form an enclosed package.

5. Apparatus as claimed in claim 1 including a sealing bar positioned on each side of said cutting means.

6. Apparatus as claimed in claim 1 including drive reduction means connected to said dispenser roll drive means and said first and second conveyor means, said drive reduction means being adapted to vary the speeds of said dispenser roll and said first and second conveyor so that said speeds remain in constant relationship.

7. Apparatus as claimed in claim 1 wherein said roll dispenser means is a "doughnut" shaped member with a rotatable mounted roll holding shaft secured thereto.

8. Apparatus as claimed in claim 1 wherein said conveyor means is a pusher apparatus which physically pushes each load into the wrapping station.

9. Apparatus for wrapping a plurality of loads, each load comprising a plurality of members, and unitizing the loads into wrapped packages comprising: conveyor means adapted to receive a plurality of loads, wrapping means comprising a frame, a circular ring member rotably mounted on said frame, guide wrapping rail means substantially providing support to said load and axially aligned with said conveyor means to receive loads carried by said conveyor means and positioned within said ring member, said guide wrapping rail means comprising at least two rail members angularly positioned with respect to each other, a rotatable shaft secured to said ring member adapted to hold a roll of material, drive means connected to said ring member to rotate said ring member so it continuously dispenses material around said guide rail means and the load currently being carried by said guide rail means to form a spiral wrapped load; said roll of material defining a path during the wrap cycle which path provides that the roll of material is always a constant distance from the center of the roll dispenser means, brake means connected to said ring member and adapted to engage the roll of material supported on said shaft, said brake means being self adjusting to place a constant and uniform tension on said material roll causing said material to be substantially uniformly stretched when wrapped around said load, a second conveyor means positioned adjacent to said guide rail means adapted to carry said continuously spiral wrapped plurality of loads away from said wrapping means and cutting means positioned adjacent said second conveyor means, said cutting means being adapted to vertically reciprocate and thereby cut through material wrapped around said loads to separate each load into a unitary package, said cutting means comprising a frame means and a plurality of linearly aligned pins mounted on said frame means, said pins being adapted to puncture said tensioned material, the holes formed by said pins in said tensioned material when punctured shear the tensioned material in a substantially straight line.

10. Apparatus as claimed in claim 9 wherein said guide wrapping rail means comprises a support secured to said first conveyor means and rail members secured to said support.

11. Apparatus as claimed in claim 9 wherein said frames are "V" shaped in configuration.

* * * * *